US010967497B1

(12) United States Patent
Lopez

(10) Patent No.: US 10,967,497 B1
(45) Date of Patent: Apr. 6, 2021

(54) MULTIPURPOSE DRYWALL INSTALLATION AND FRAMING TOOL

(71) Applicant: Hector R. Lopez, Acambaro (MX)

(72) Inventor: Hector R. Lopez, Acambaro (MX)

( * ) Notice: Subject to any disclaimer, the term of this patent is extended or adjusted under 35 U.S.C. 154(b) by 133 days.

(21) Appl. No.: 16/439,497

(22) Filed: Jun. 12, 2019

(51) Int. Cl.
*B25F 1/04* (2006.01)
*B25G 1/10* (2006.01)

(52) U.S. Cl.
CPC ..... *B25F 1/04* (2013.01); *B25G 1/102* (2013.01)

(58) Field of Classification Search
CPC ... B25F 1/04; B25G 1/102; B27L 7/06; B66F 7/243; B66F 15/00; E04F 21/1894
See application file for complete search history.

(56) References Cited

U.S. PATENT DOCUMENTS 2,692,753 A * 10/1954 Masterson, Jr. .... E04F 21/1894 254/131
2,989,286 A * 6/1961 Gillespie ..... E04G 21/26 254/120
5,695,172 A * 12/1997 Hreha ..... B25C 11/00 254/18
5,814,842 A * 9/1998 Muldoon ..... B66F 15/00 254/131
6,678,909 B1 * 1/2004 Pyatt ..... B23D 71/04 254/131
6,913,246 B1 * 7/2005 Skach ..... B25C 11/00 254/131
6,988,711 B2 * 1/2006 Skach ..... B25C 11/00 254/131
8,365,332 B2 * 2/2013 Allen ..... B66F 15/00 7/166
8,434,739 B1 * 5/2013 Connolly ..... F16B 7/105 254/130
9,656,379 B2 * 5/2017 Doster, Jr. ..... E04F 21/18
2015/0048287 A1 * 2/2015 Chernyshou ..... B66F 15/00 254/129
2018/0257212 A1 * 9/2018 Preston ..... B66F 15/00
2019/0136550 A1 * 5/2019 Fisher ..... E04F 21/04

* cited by examiner

*Primary Examiner* — David B. Thomas
(74) *Attorney, Agent, or Firm* — JRG Attorneys at Law

(57) ABSTRACT

A multipurpose construction device comprised of a frame having a substantially solid rigid body. The frame includes a horizontal lip configured to be inserted beneath a construction panel to lift it upward by applying pressure to a kicker via a user's foot. The frame also includes an uppermost member having first and second segments. The first segment includes a work surface area and the second segment is configured to project downward to form a palm support area to allow users to place their palm thereon when using a rasp. The rasp is coupled to the bottom of the frame. The kicker is comprised of a multifunctional hook-like mechanism that allows a user to lift a drywall panel upward or secure the hook-like mechanism on a belt or the like. The multipurpose construction device also includes plurality of holding units to fixedly store construction tools.

20 Claims, 15 Drawing Sheets

MULTIPURPOSE DRYWALL INSTALLATION AND FRAMING TOOL

TECHNICAL FIELD

The present invention relates generally to tools, more particularly, to a multipurpose drywall and framing tool used in the construction industry for installing walls within buildings.

BACKGROUND OF THE INVENTION

Drywall, also known as plasterboard, wallboard, or gypsum board, is a type of paneling that is commonly used to construct the interior walls and ceilings of houses, offices and other buildings. Drywall is typically made up of an inner core of gypsum plaster pressed between two thick sheets of paper and can be manufactured in various lengths and thicknesses for use in many different applications. To install drywall panels, each panel is cut into desired shapes and sizes and then secured to wall or ceiling structures with nails, glue, screws or other suitable fasteners.

Installing drywall requires several specialized tools to mount and hang the heavy paper-wrapped gypsum sheets. The drywall sheet normally ranges from 4×8 foot sheets to 4×12 foot sheets that must be arranged and held along the support studs that form the frame of the wall or ceiling and then be screwed, nailed or otherwise attached using suitable fasteners to the support studs. Full sheets may be mounted vertically or preferably horizontally along the studs and be cut to the proper dimensions to form the walls and ceiling of a room. Commonly, the sheets are mounted to the studs in an offset alignment to prevent seams from one sheet aligning along the entire length or width of a room.

Installation of drywall generally requires more than one worker to complete, as it is often necessary for one worker to hold a drywall panel in place while a second worker secures the panel to the underlying wall studs or ceiling joists. Requiring more than one worker to install each drywall panel prolongs the time it takes to complete the construction job as other work must be put on hold so that at least two workers can assist each other with the drywall installation. This reduces efficiency which inevitably leads to higher construction costs.

Tools of the prior art used to install drywall sheets may include a blade or utility knife to cut the drywall sheets to the proper dimensions; a hammer to pound nails; a screw and/or nail puller to pull out misaligned screws or remove screws left in the studs after removing the old drywall and wall coverings; a lift support that has an extended flat metallic strip with a tapered point on one end that may be inserted under a drywall sheet and then pivoted on a base leg by stepping on the opposing end of the metallic strip to provide for a sheet to be lifted and held in place for attachment to the studs; and/or a rasp that is configured and required for smoothing edges of the drywall after cutting to have the drywall sheets cleanly fit together along a seam.

An installer of drywall must have a variety of tools readily available to properly and efficiently install drywall sheets to finish the walls and ceilings of a room and/or building. Having to carry a number of different tools to install drywall can be a daunting task since drywall installers could easily lose and/or forget to bring one or more of the necessary tools from one work area to another work area with them which could end up prolonging the task of installing new drywall.

In light of the shortcomings in the prior art, there is clearly a need for a new multipurpose drywall and framing tool that is easy for a user to carry and use which has an assortment of tools for completing most of the common tasks necessary to install construction items such as drywall.

SUMMARY OF THE INVENTION

The present invention relates to a new multipurpose drywall installation and framing tool.

The present invention further relates to a new multipurpose installation and framing tool having a one-piece frame comprised of a substantially rigid body.

One aspect of the present invention is to provide a multipurpose tool that is integrated to include a plurality of holding units configured to hold and/or store construction tools such as a chalk reel and/or a level (e.g., torpedo level).

The bottom portion of the frame will include a rasp tool having a grinding surface to advantageously smooth edges of construction items such as drywall after cutting.

In one embodiment, the front portion of the frame includes a horizontal lip having a top surface and the frame also includes a palm support area to allow the user to place his or her palm thereon when using the rasp to smooth edges of a construction panel after cutting.

In another embodiment, the rear area of the multi-functional tool includes a multifunctional hook-like mechanism having a kicker area.

In various embodiments, the top surface of the horizontal lip is configured to be placed underneath construction items such as drywall, wallboards, doors, plywood or paneling and the construction items will be lifted upward when pressure is applied to the kicker via a user's foot.

In various embodiments, the multifunctional hook-like mechanism will advantageously allow a user to secure the multifunctional tool to a pouch, pocket, belt, or the like via the hook-like mechanism, making the tool easily accessible.

An additional feature of the present invention is to provide a screw or nail pulling/removing device having a substantial diamond shape and a hex port configured to store and also operate a hex shaft having a flat top or a Philips tip. These devices will be affixed to preselected areas disposed on the frame of the multifunctional tool, preferably at the rear port.

A further feature of the present invention is to provide at least one rear port located at the rear portion of the multifunctional hook-like mechanism. The rear port will be configured to store a writing device such as a pencil and/or a shaft tool such as a Philips screwdriver tip or shaft.

In one embodiment, the first segment of the uppermost member will be adapted to include a work surface area to hold/store a note pad and/or various magnets.

In various embodiments, the frame of the multipurpose tool will be configured to house/hold a plurality of magnets for use in the construction industry.

In another embodiment, the left and right side wall assemblies of the multipurpose tool will be adapted to include measured markings for measuring distance.

For a better understanding of the present invention, its functional advantages and the specific objects attained by its uses, reference should be made to the accompanying drawings, claims and descriptive matter in which there are illustrated embodiments of the invention.

DETAILED DESCRIPTION

Figure 1A:
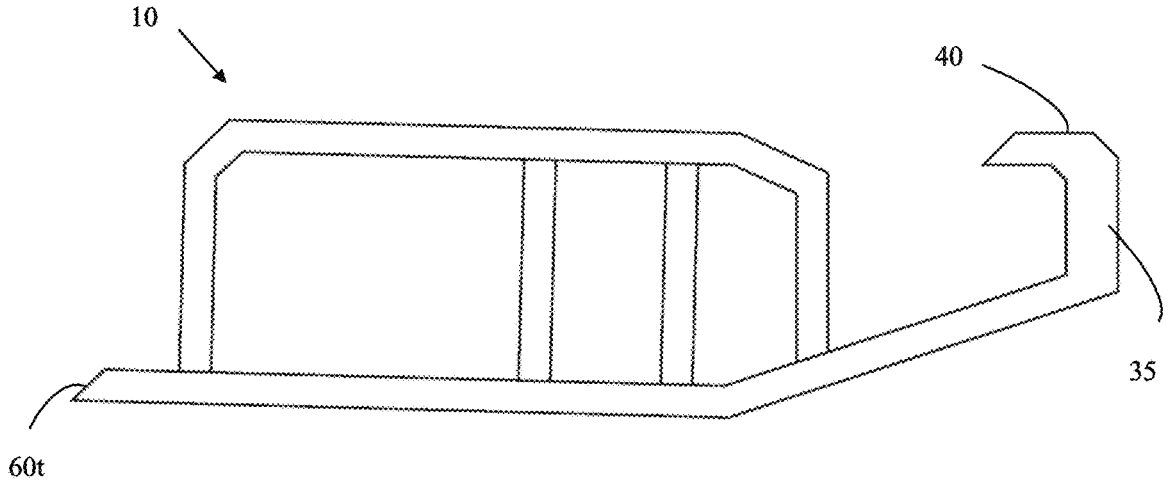
FIGS. 1A-1C and 1F-1G show various views of the multipurpose tool.

The following detailed description is of the best currently contemplated modes of carrying out various embodiments of the invention in which said embodiments can be carried out independently and/or in combination. The description is not to be taken in a limiting sense but is made for at least the purpose of illustrating the general principles of the invention, since the scope of the invention is best defined by the appended claims.

With reference to FIGS. 1A-1C and 1F-1G, various embodiments of the present invention are depicted showing multipurpose construction devices (10) comprised of a one-piece frame having a substantially solid rigid body. The multipurpose device (10) will also include a base comprised of a first segment (15) and a second segment (20) defined by a longitudinal axis (100) that is parallel to a ground surface (95) a shown in FIG. 1C.

Figure 1B:
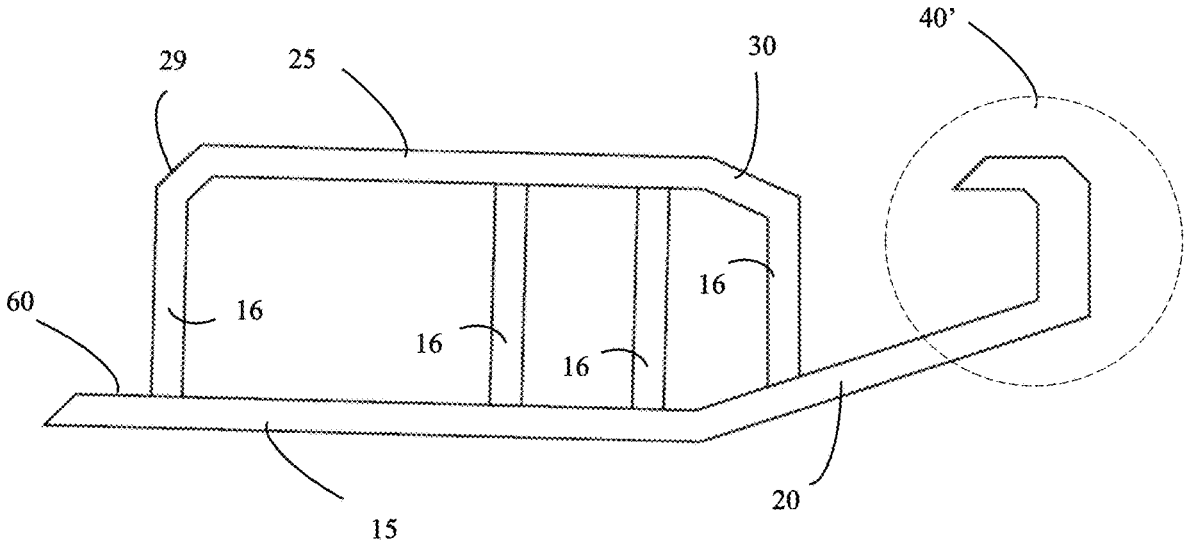
Figure 1C:
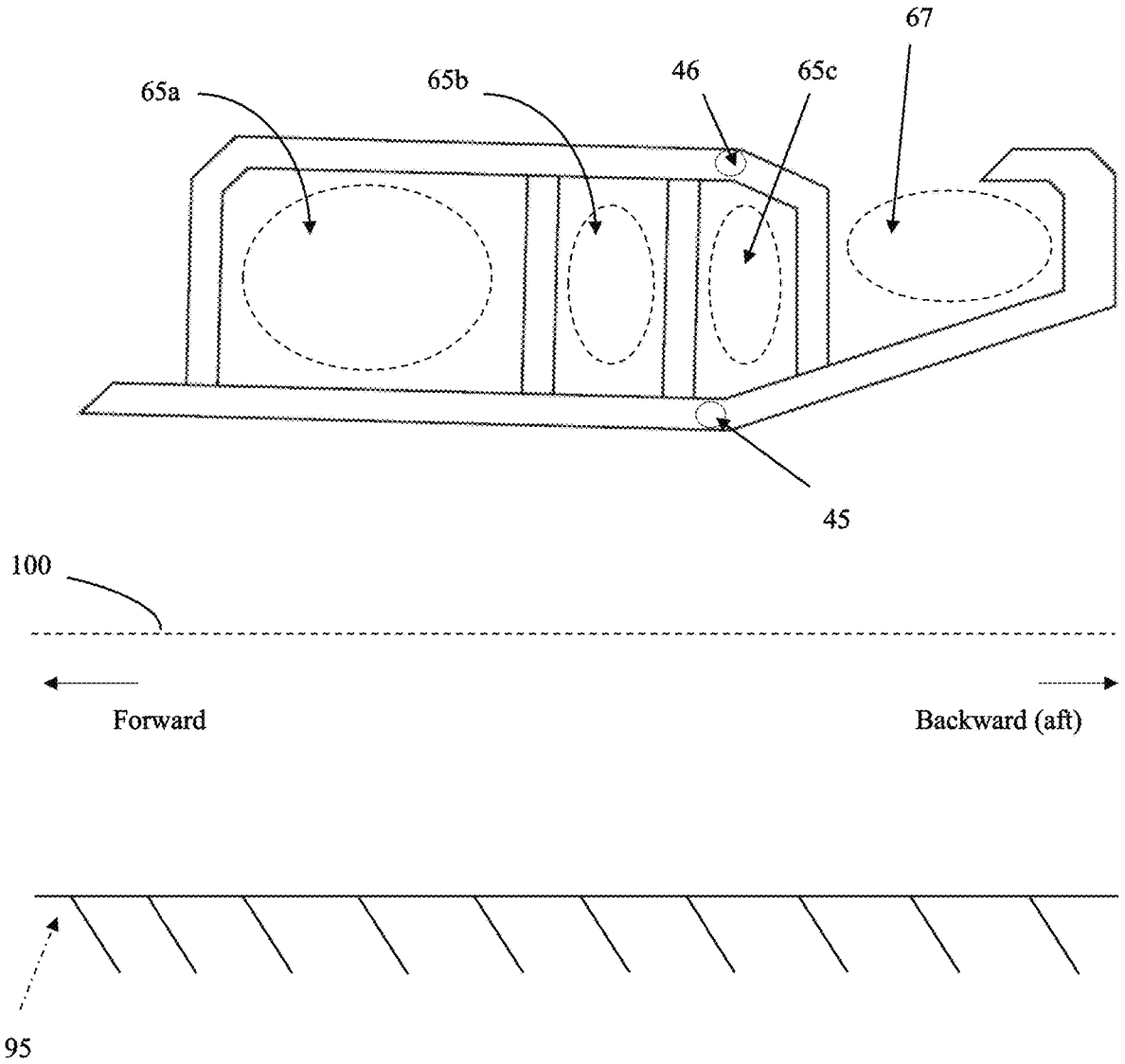
Figure 1D:
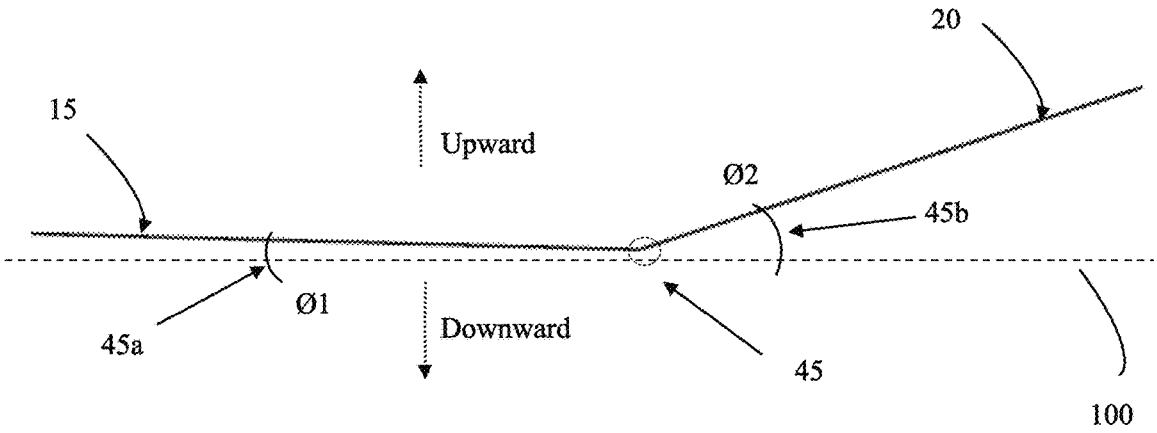
FIGS. 1D-1E illustrate the first, second and third predefined angles.

Referring still to FIGS. 1A-1C and 1F-1G, the first segment (15) and second segment (20) of the base each have a top surface and a bottom surface opposite to each other. The first and second segments (15/20) of the base also have a predefined length and a predefined width. The base further includes a first axis of rotation (45) located substantially at a point where the first and second segments of the base are joined as depicted in FIGS. 1C-1D.

In one embodiment of the present invention, the multipurpose construction device (10) can be comprised of the following parameters: height of device is in the range of to 2⅛ inches to 2⅜ inches, width of device is in the range of 2 inches to 2¼ inches and length of the device is in the range of 8 inches to 9 inches. The vertical thickness of the first segment (15) and second segment (20) of the base is in the range of 3/16 inches to 5/16 inches. The vertical thickness of the ribs is in the range of 1/16 inches to 3/16 inches.

Figure 1E:
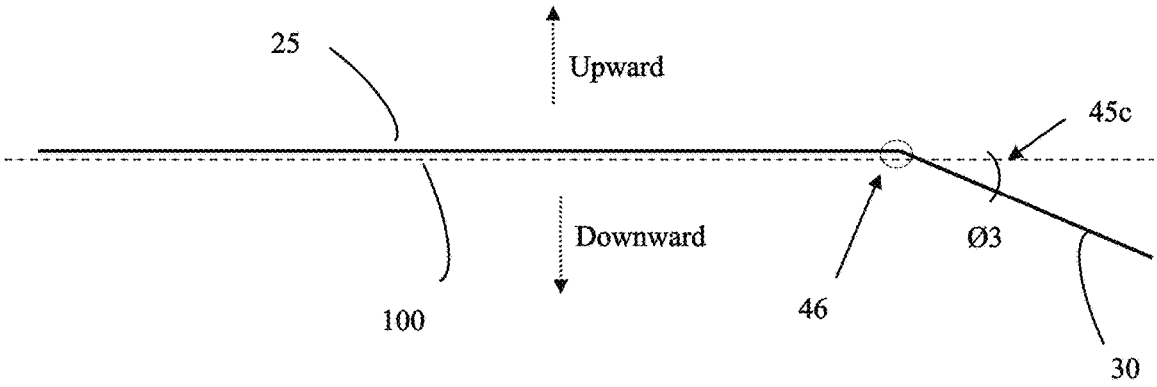
Figure 1F:
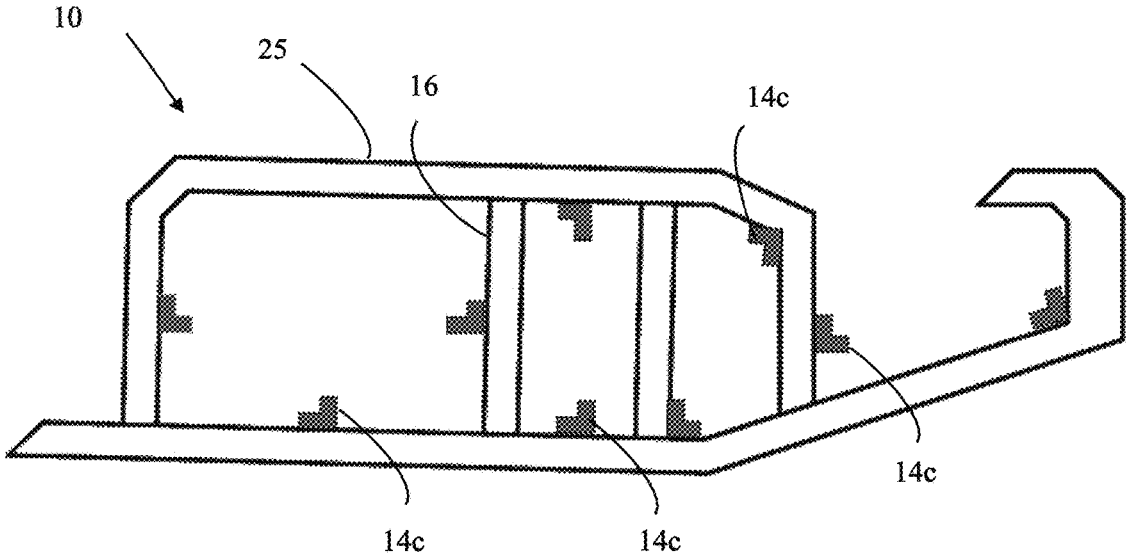
Figure 1G:
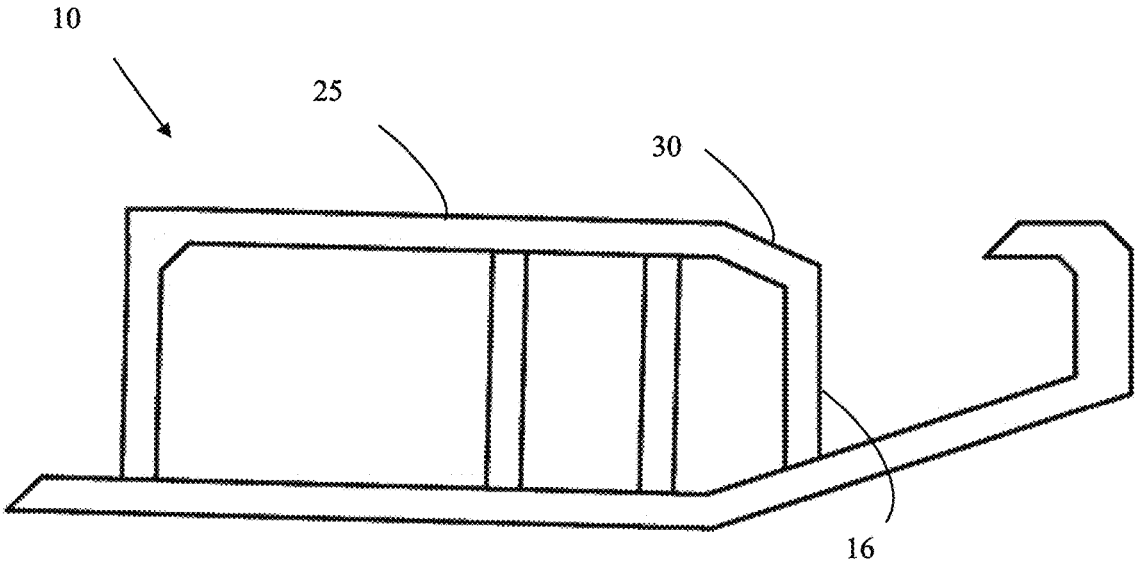

The present invention may be formed as a single piece of steel, titanium, iron, beryllium, Monel, tungsten, Inconel, or other metallic compounds or in combination with other materials such as wood or composite plastics having acceptable rigidity and strength. Also, the present invention can be formed by a 3-D printer as a single piece or manufactured as a single piece or can be created in separate pieces that are coupled together by bolts, screws, welded together or the like. As illustrated in FIG. 1F, the present invention can also include securing/coupling devices (14*c*) built/formed on the single piece frame to allow a plurality of construction tools to be coupled to the frame (e.g., levels, chalk reel). Alternatively, the constructions tools can be coupled to the single piece frame by bolts, screws, weld or the like.

As shown in FIGS. 3A-3C and 3F, the bottom surface (15*s*) of the first segment (15) of the base can include a rasp holder (77) and/or a rasp (76) (See FIG. 3D-3E) or it can be fabricated to cover most of the bottom surfaces (15/20). An optional rasp holder may be affixed to the bottom surface of the first segment using screws, bolts, a weld, rivets or any other means for attaching the rasp and rasp holder thereon. In use, the rasp will be used to remove rough edges or uneven surfaces formed during cutting of the drywall sheet. For example, the rasp (76) can be moved back and forth along an uneven edge to remove errant plaster pieces.

Figure 9A:
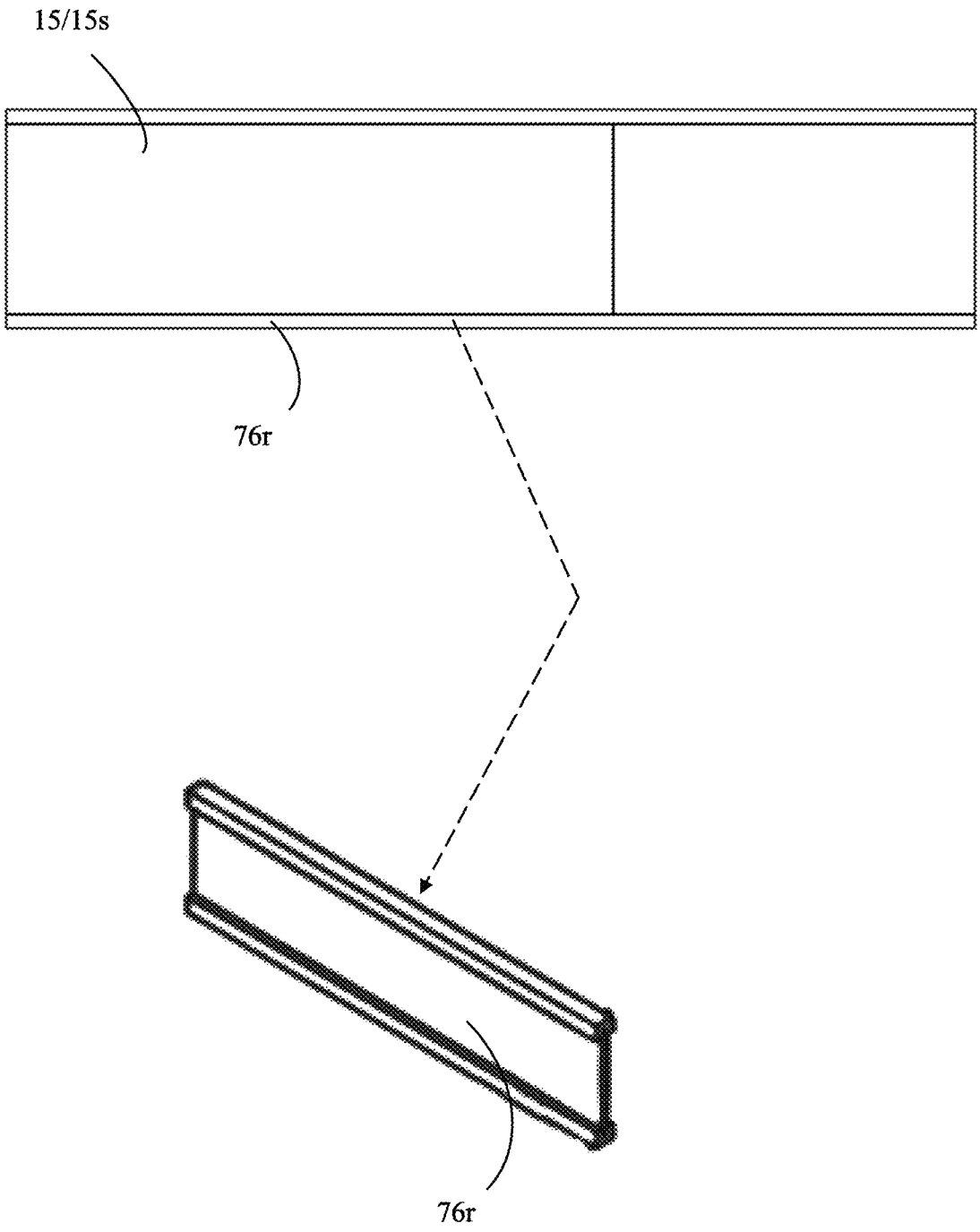
FIGS. 9A-9B are directed to a bottom view of the present invention showing the ribs.
Figure 9B:
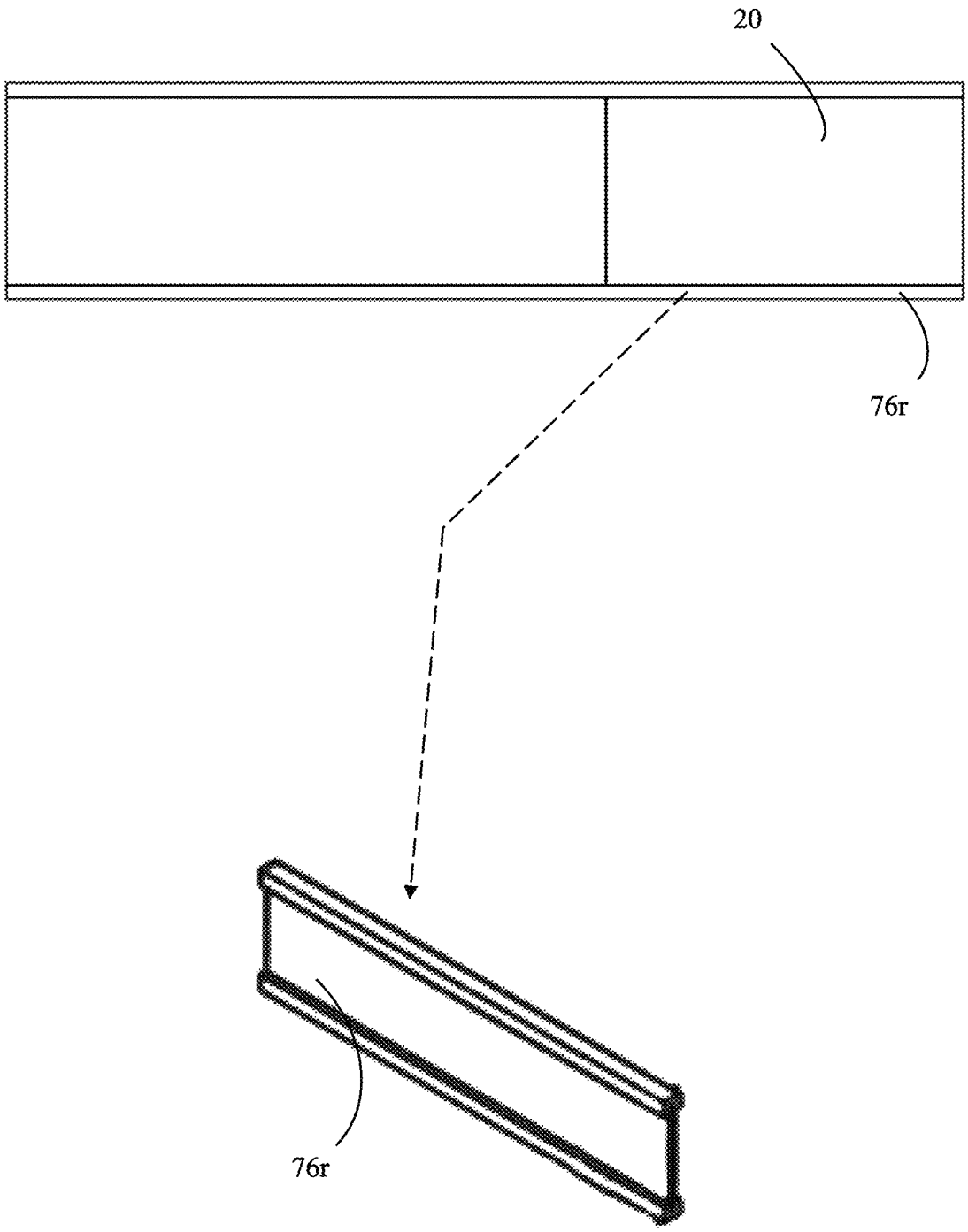

FIGS. 9A-9B show optional protruding ribs (76*r*) that are disposed at the side of the rasps (76) (See also FIGS. 3A-3C and 3F). In one embodiment, the ribs (76*r*) are disposed on left and right sides/edges of the bottom surface of the first segment (15). In use, the protruding ribs (76*r*) prevent the rasp (76) from rubbing against the ground when a user applies pressure to the kicker (40) with his or her foot to lift a construction panel (70) upward. Basically, the protruding ribs are configured to extend the useful life of the rasp.

Referring still to FIGS. 9A-9B, the left and right sides/edges of the bottom surface of the second segment (20) can also include optional ribs (76*r*) if a rasp (76) is included. In use, the protruding ribs (76*r*) prevent the rasp (76) from rubbing against the ground when a user applies pressure to the kicker (40) with his or her foot to lift a construction panel (70) upward. The ribs (76*r*) of this embodiment will extend the useful life of the rasp.

In various embodiments of the present invention, the first segment (15) of the base is configured to project upward at a predefined first angle (45*a*/Ø1) relative to the longitudinal axis (100) as shown in FIG. 1D. The second segment (20) of the base is also configured to project upward at a predefined second angle (45*b*/Ø2) relative to the longitudinal axis (100) as shown in FIG. 1D. The predefined angle of the second segment (45*b*/Ø2) of the base is larger than the predefined angle of the first segment (45*a*/Ø1) of the base.

Referring now to FIGS. 1A-1C and 1F-1G, a plurality of vertical support members (16) are affixed perpendicular to the top surface of the base (15/20). The vertical support members (16) will have a predefined height and a predefined width (16*w*). The predefined width of the vertical support members (16) will be substantially the same as the predefined width of the base. Also, the width of the vertical support members will be configured to be aligned with the width of the base.

In a further embodiment, the uppermost member (25/30) of the present invention is comprised of first (25) and second segments (30) as illustrated in FIG. 1B. Each of these segments (25/30) have a top surface area and a bottom surface area opposite to each other. As shown in FIGS. 1A-1C, 4A-4B, and 8A-8B, the bottom surface area of the uppermost member (25/30) is affixed/attached to top surface areas of the vertical support members (16) forming a plurality of holding units (65) disposed below the uppermost member (25/30) for holding construction tools (See FIGS. 1C-1D). The uppermost member (25/30) further includes a second axis of rotation (46) located substantially at a point where the first and second segments of the uppermost member are joined as depicted in FIGS. 1C and 1E.

In various embodiments, the second segment (30) of the uppermost member is configured to project downward at a third predefined angle (45*c*/Ø3) relative to the longitudinal axis (100) to form a palm support area (30) as shown in FIGS. 1B, 1E, 2A-2B and 7B).

In use, the second segment (30) of the uppermost member forms the palm support area (30) to allow the user to place his or her palm thereon when using the rasp (76) to smooth edges of a construction panel (70) after cutting (See FIGS. 2A-2B, 3A-3C and 7B).

Figure 7A:
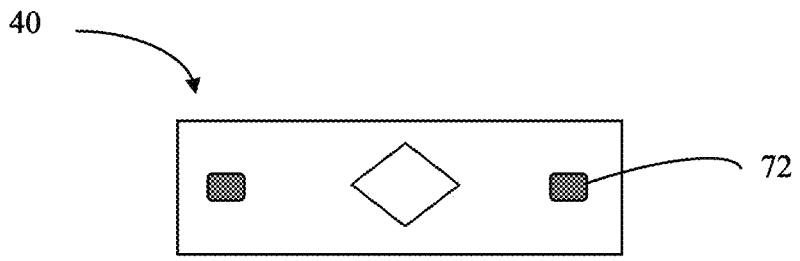
FIG. 7A is directed to the horizontal segment of the kicker.
Figure 7B:
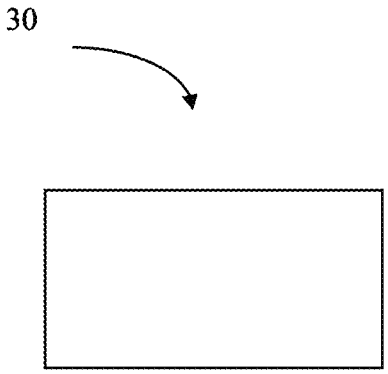
FIGS. 7B-7C are directed to various embodiments of the palm and finger support areas.
Figure 7C:
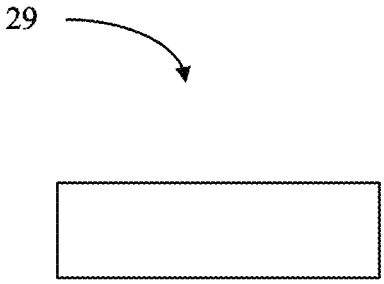

In an optional embodiment, the first segment of the uppermost member could include a finger support area (29) to allow users to place their fingers thereon when using the rasp (76) to smooth edges of a construction panel (70) after cutting (See FIGS. 1B and 7C). The finger support area (29) is configured to project downward at a predefined angle relative to the longitudinal axis (100) to form said finger support area (29) (See FIGS. 1B and 7C). In another embodiment, the first segment of the uppermost member does not have a finger support area (See FIG. 1G).

As shown in FIG. 1C, the plurality of holding units (65) of one embodiment are comprised of a first holding unit (65*a*), a second holding unit (65*b*) disposed aft of the first holding unit (65*a*), a third holding unit (65*c*) disposed aft of the second holding unit (65*b*), and an open holding unit (67) that is disposed aft of the third holding unit (65*c*). The broken lines forming the circular shapes in FIG. 1C are to illustrate the areas where the holding units are to be approximately located.

In an optional embodiment, the first, second and third holding units are each configured to store at least one construction tool. The open holding unit (67) is also configured to fixedly store at least one construction tool. The construction tools can be, but are not limited to, a tape measure, drywall knife, utility knife, sanding sponge, screwdriver, pencil, levels, and chalk reel. The construction tools of the present invention can be fixedly stored and/or coupled in the holding units by bolts, fasteners, Velcro, screws, pins, rods, weld, nails, glue, cement, rivets, or the like.

Figure 4A:
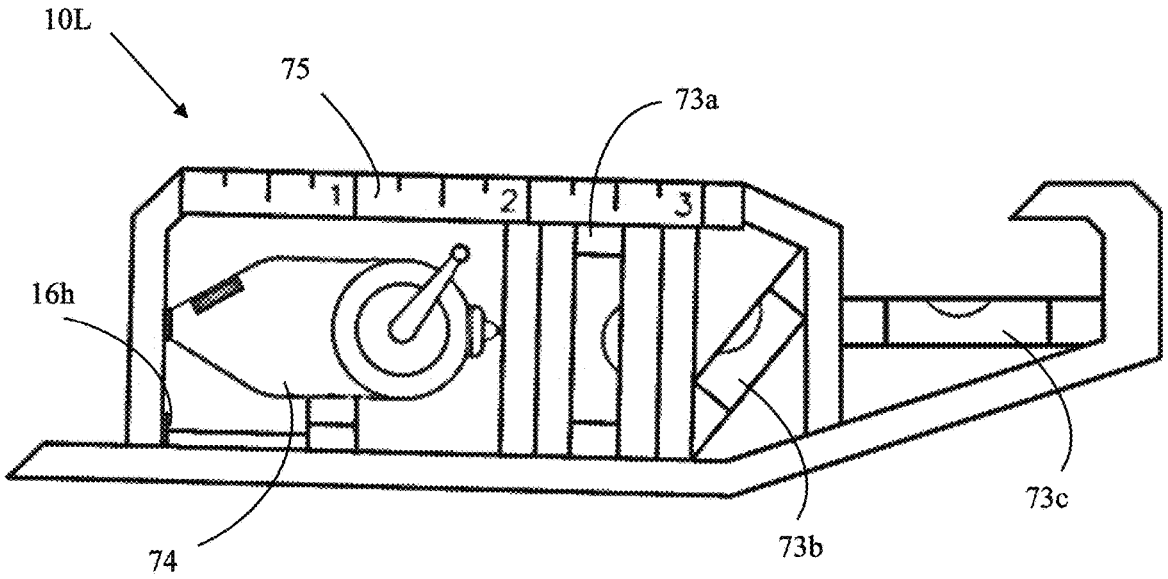
FIGS. 4A-4B are directed to left and right side views of the present invention.
Figure 4B:
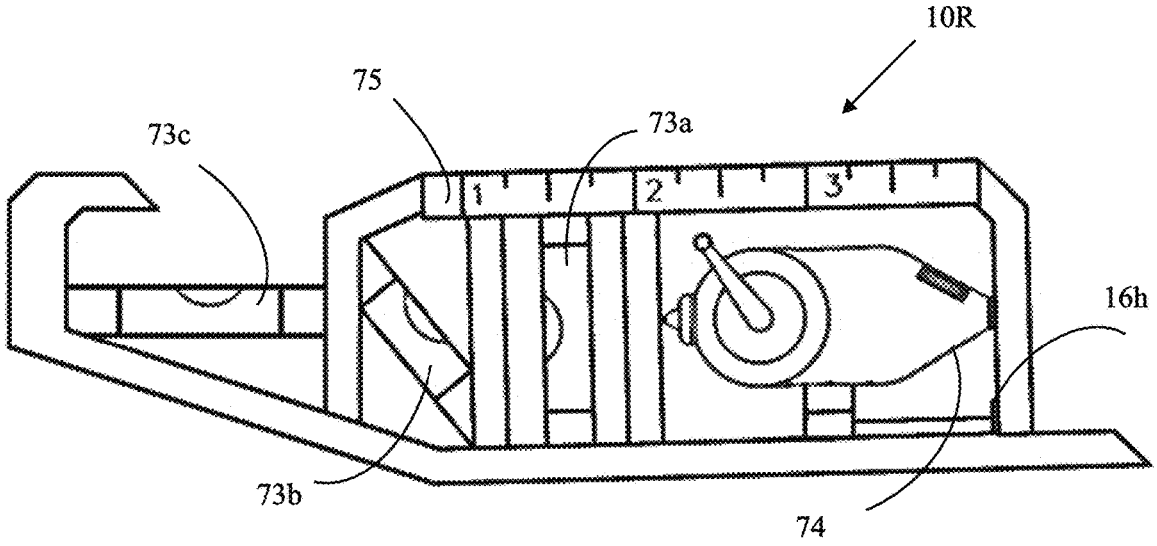

Referring to FIGS. 1A and 4A-4B, the first holding unit (65*a*) is configured to store/hold an optional chalk reel (74). In use, the chalk reel is configured to mark a long, straight line on a flat surface. In another embodiment, the second holding unit (65*b*) is configured to store/hold a first level (73*a*), the third holding (65*c*) unit is configured to store/hold a second level (73*b*), and the open holding unit (67) is configured to store/hold a third level (73*c*). In use, the first, second and third levels are configured to indicate straightness. The construction tool may be affixed to the bottom, top and/or side surface walls of the holding units using screws, bolts, a weld, rivets or any other means for attaching/mounting the construction tools therein.

In another embodiment, the first, second and third levels are configured to form in combination a torpedo level for indicating straightness as shown in FIGS. 4A-4B. It is well known to a person skilled in the construction field how the levels will be used to measure straightness.

In further embodiment of the present invention, the vertical support members (16) of the holding units (65) each have a width (16*w*) that is substantially the same as the width of the base and are also aligned with the width of said base (See FIGS. 2A, 5, and 8A-8B). In another embodiment of the present invention, the front vertical support member (16*f*) of the first holding unit (65*a*) has a port opening (16*h*) configured to allow a chalk line of the chalk reel to extend therethrough for laying out straight lines or the like (See FIGS. 5 and 4A-4B). The front vertical support member (16*f*) of the first hold unit (65*a*) will also include at least one magnet (72) disposed thereon. In various embodiments of the present invention, the width of the vertical members (16) and of the base is in the range of 2 inches to 2¼ inches.

As shown in FIGS. 1A-1C and 4A-4B, the second holding unit (65*b*) is comprised of a second vertical support member that is aft of the front vertical support member (16*f*) and a third vertical support member that is aft of the second vertical support member. The third holding unit (65*c*) is comprised of the third vertical support member and a fourth vertical support member that is aft of the fourth vertical support member.

Figure 2A:
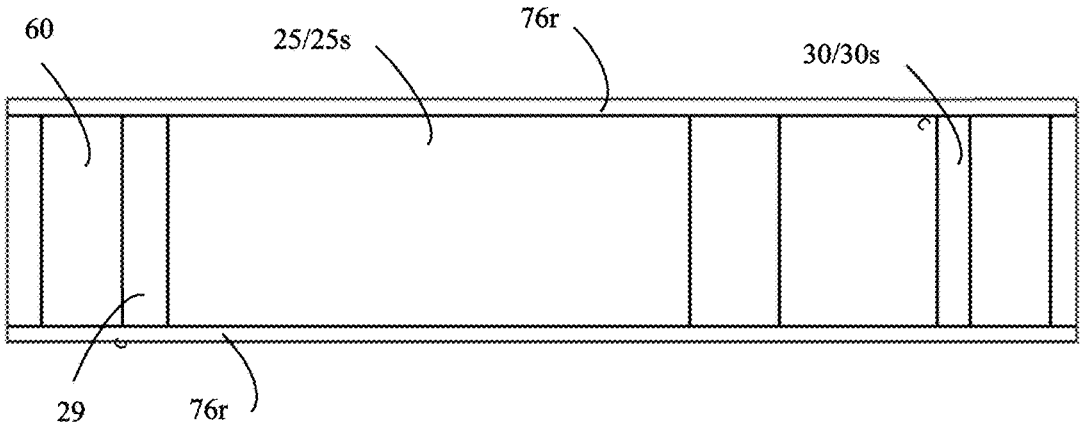
FIGS. 2A-2B show top views of the multipurpose tool.
Figure 2B:
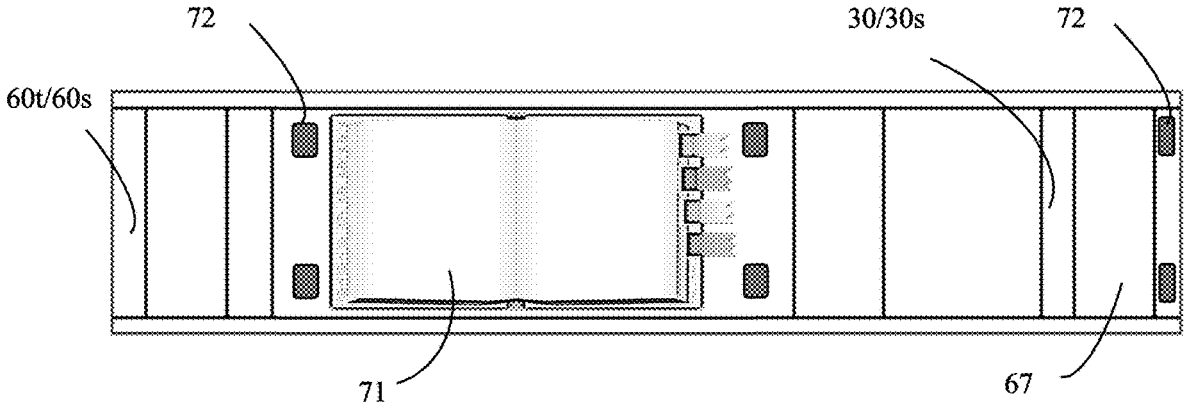

In an optional embodiment, a work surface area (25*s*) is disposed on the top surface area of the first segment (25) of the uppermost member as shown in FIGS. 2A-2B.

In another embodiment of the present invention, the multipurpose construction device (10) includes a note pad (71) and a plurality of magnets (72) that are coupled and/or mounted to the work surface area (25*s*) as shown in FIG. 2B and on the horizontal segment (40) of the kicker area (40') as shown in FIG. 7A.

Referring to FIGS. 1A-1B and 8A-B, a kicker area (40') is comprised of a vertical segment (35) that has a predefined height and a horizontal segment (40) having a predefined length. A bottom portion of the vertical segment (35) is affixed to a top end point of the second segment (20) of the base. The horizontal segment (40) is affixed to a top portion of the vertical segment (35) and is configured to extend forwardly at a preselected length. The horizontal segment (35) is disposed substantially parallel to the ground (95) and the vertical segment (35) is disposed perpendicular to the horizontal segment (40) forming a multifunctional hook-like mechanism (40').

Referring to FIG. 7A, the horizontal segment (40) of the kicker area (40') will include a plurality of magnets (72) disposed on the top surface of the horizontal segment (40). The horizontal segment (40) will also include a diamond shaped nail remover (78) disposed thereon. In the preferred embodiment of the present invention, the diamond shaped nail remover (78) will be disposed between two magnets (72) as shown in FIG. 7A. The diamond shape nail remover (78) will be comprised of a cavity like hole/opening configured to allow the tips/heads of nails, tacks, screws, or the like to be extracted. It is well known to a person skilled in the construction field how diamond shaped nail removers (78) are used.

In use, the magnets (72) located on the top surface area of the multipurpose construction device (10) can magnetically hold the device (10) in place to a wall when said device (10) is attracted to the nails or screws holding the drywall/baseboard to the studs (See FIG. 2B). When the device (10) is magnetically held in place against the drywall/baseboard, a user can now use the levels (73) and the measured markings (75) (e.g., ruler) of the device (10) to accurately complete the process of installing drywall/baseboards with greater precision.

In another embodiment, a kicker area (40') is comprised of a vertical segment (35) that has a predefined height and a horizontal segment (40) having a predefined length. The vertical segment (35) is affixed to the second segment (20) of the base as shown in FIG. 1A. The horizontal segment (40) is affixed to the vertical segment (35) and is configured to extend forwardly at a preselected length as shown in FIG. 1A. The horizontal segment (35) is disposed substantially parallel to the ground (95) and the vertical segment (35) is disposed perpendicular to the horizontal segment (40) forming a multifunctional hook-like mechanism (40').

In use, the hook-like mechanism (40') allows the multipurpose construction device (10) to be secured to a pouch, pocket, belt or the like of a user.

In various embodiments of the present invention, the top surface area of the uppermost member (25/30) is substantially level (aligned with) the top surface area of the horizontal segment (40) of the kicker area (40') as shown in the accompanying drawings.

In various embodiments, an open holding unit (67) is disposed between the kicker area (40') and the palm support area (30). The open holding unit (67) is further disposed above the top surface of the second segment (20) of the base as depicted in FIG. 1C.

In another embodiment, a horizontal lip (60) projects forwardly on a front portion of the first segment (15) of the base at a preselected length as illustrated in FIG. 1B. The horizontal lip (60) further has a top surface area and a tapered tip (60*t*) that is configured to be inserted beneath a construction panel (70) (See FIGS. 1B and 8A).

Figure 8A:
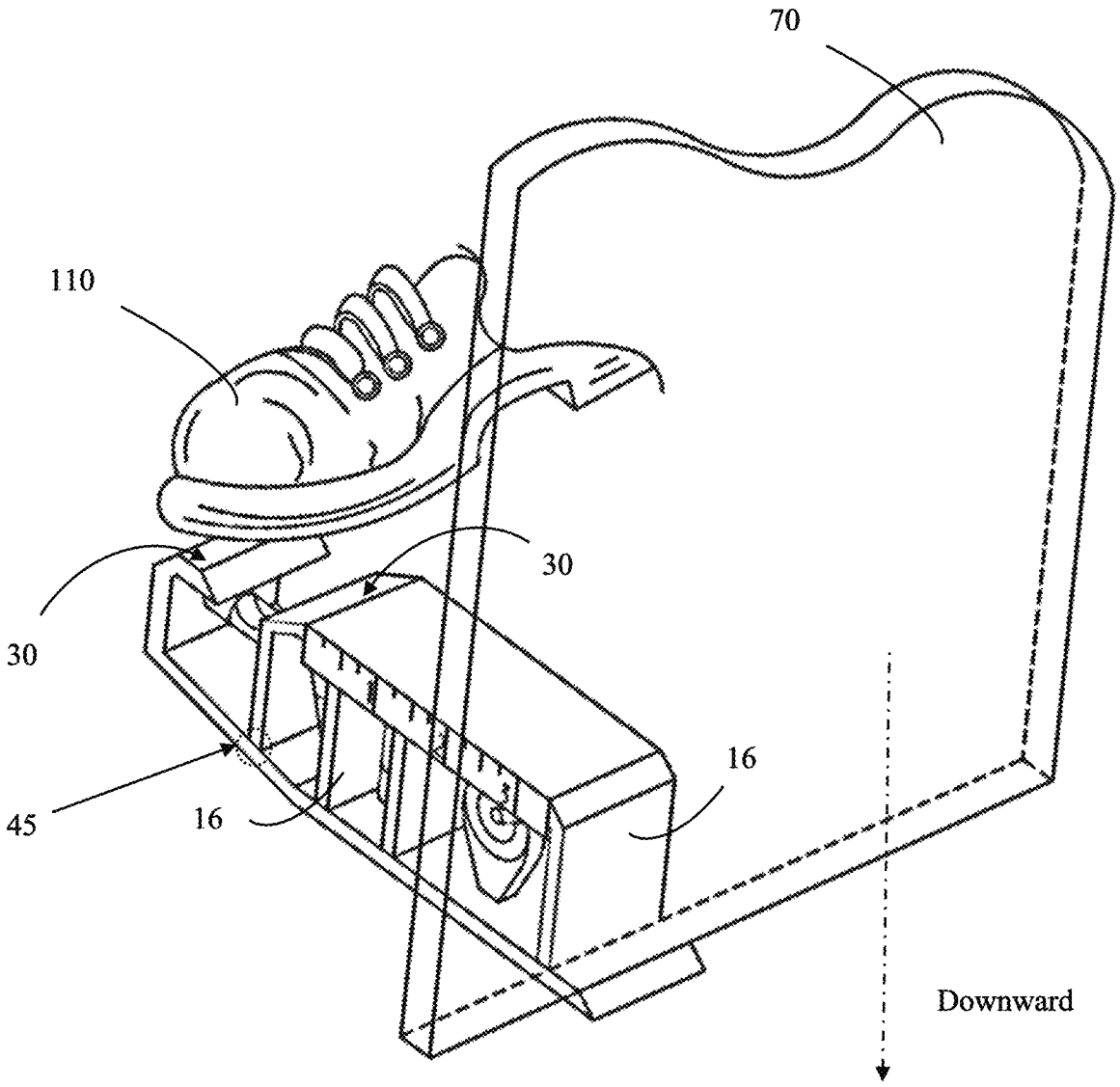
FIGS. 8A-8B are directed to views of the multipurpose tool in use.
Figure 8B:
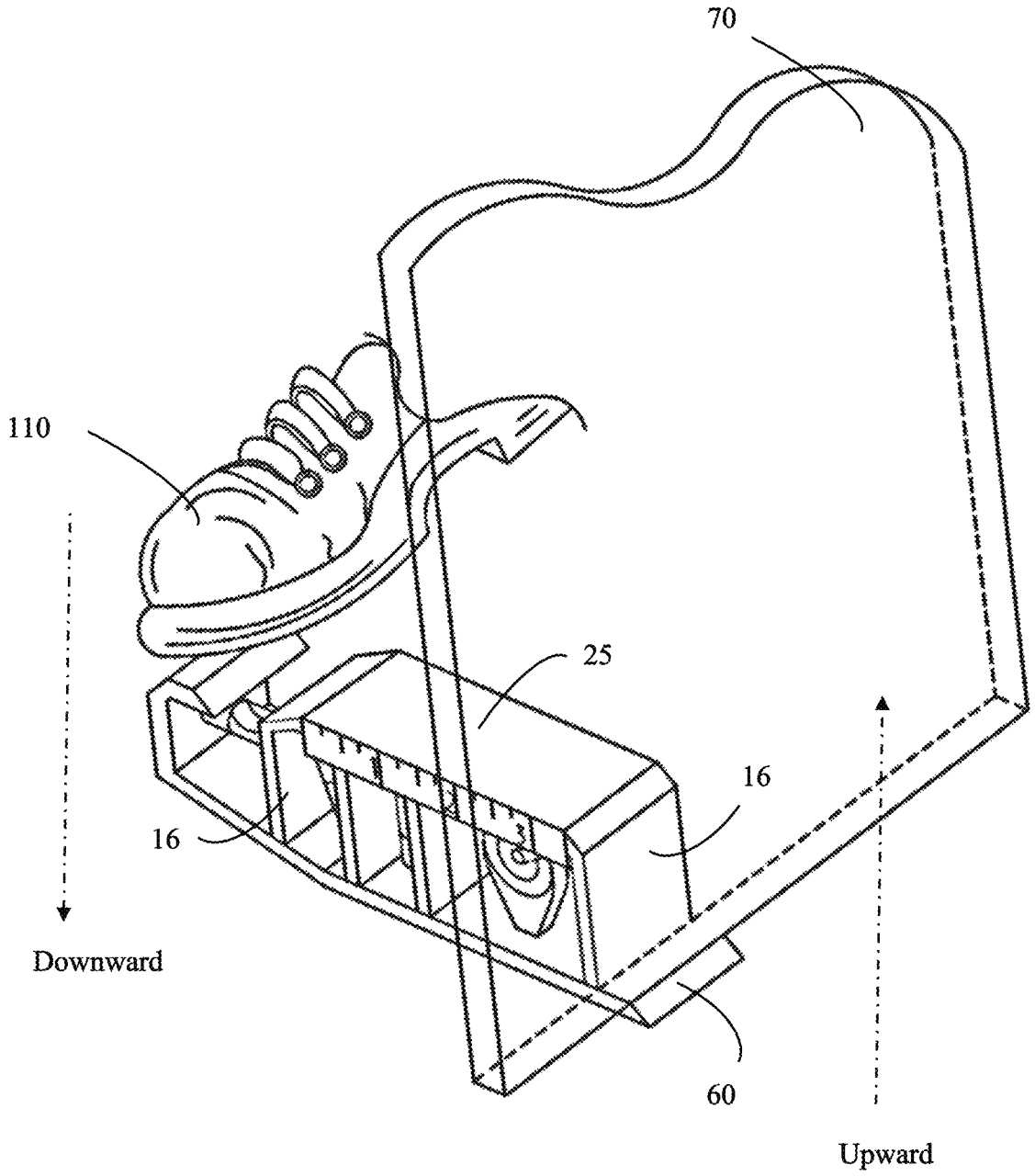

In use, the construction panel (70) is lifted upward by applying pressure to the kicker (40) via a user's foot (110) to allow the lip (60) of the multipurpose device to pivot upward (45*u*) at the axis of rotation (45) as shown in FIG. 8B.

In various embodiments of the present invention, the construction panel is a wallboard, a drywall sheet, door, or plywood.

Figure 6:
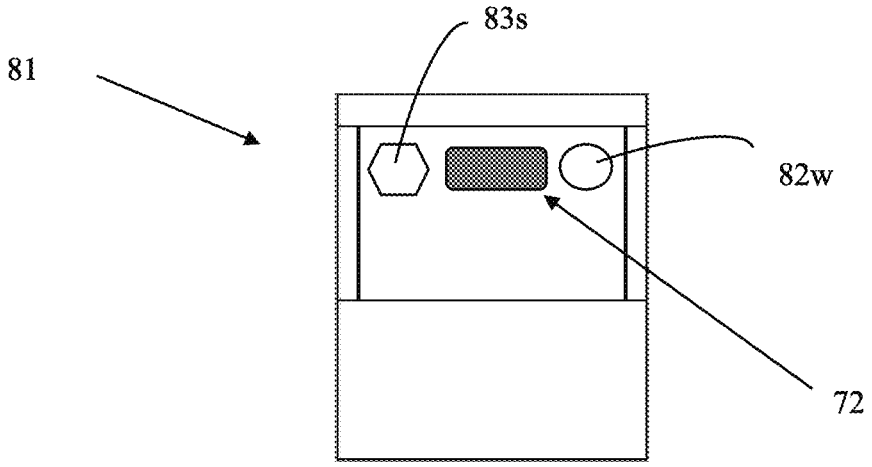
FIG. 6 is a rear view of the multipurpose tool illustrating the rear port area of the kicker.

In an alternative embodiment of the present invention, the vertical segment (35) of the primary kicker area (40') includes a rear port (81) that will have one or more loading ports as shown in FIG. 6. A first port (82) is configured to receive and store a writing device (82*w*) such as a pencil. A second port (83) (e.g., female port) is comprised of a hex port (83*s*) configured to receive and store a hex shaft in the range of 3/16 inches to 5/16 inches, preferably a hex shaft of 1/4 inches. The hex shaft will have a flat head tip or a Philips tip. In use, the hex shaft is removed from the hex port (83*s*) and then removably attached the hex port (83*s*) to be advantageously used as a screwdriver. In the preferred embodiment, at least one magnet (72) will be disposed between the first port (82) and the hex port (83).

Figure 5:
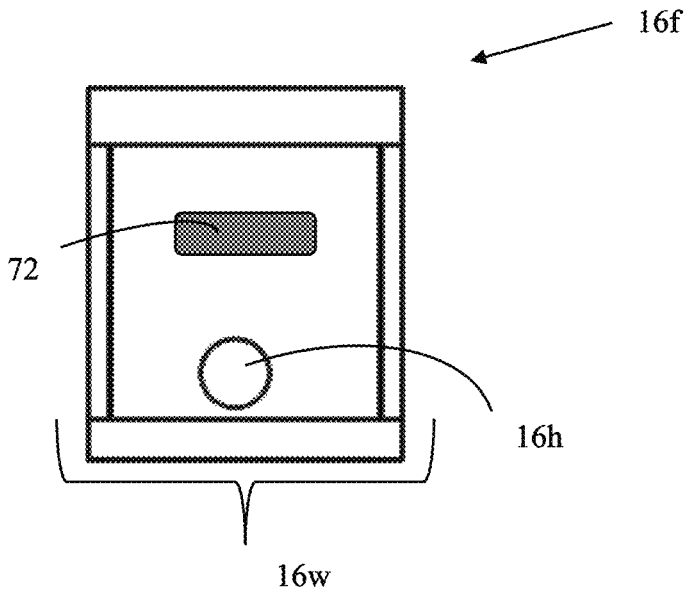
FIG. 5 shows a front view of the front vertical support member.

In use, the magnets (72) located on the front vertical support member (16*f*) of the first holding unit (65*a*) or on the rear port (81) can magnetically hold the device (10) in place when attached to a magnetic surface so that a user can use the measured markings (75) (e.g., ruler) and/or the levels (73) to accurately complete the process of installing drywall/baseboards with greater precision (See FIGS. 5 and 6).

As shown in FIGS. 4A-4B, the multipurpose construction device (10) will have left-side (10L) and right-side (10R) wall assemblies. Each wall assembly will have measured markings (75) affixed lengthwise on the left and right side surfaces of the first segment (25) of the uppermost member to allow a user to take measurements when needed. The measured markings can be derived from the metric system or from the United States customary system or from any measurement system in the world used for making measurements in the construction industry.

Figure 3A:
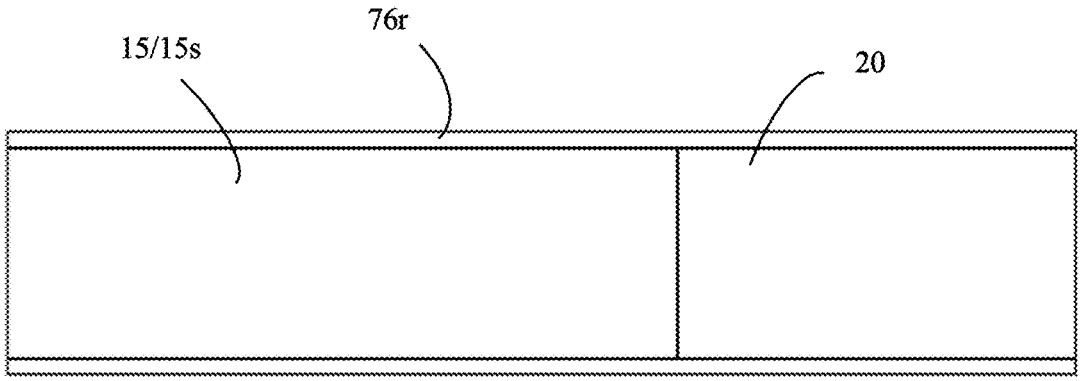
FIGS. 3A-3C and 3F show bottom views of the present invention.
Figure 3B:
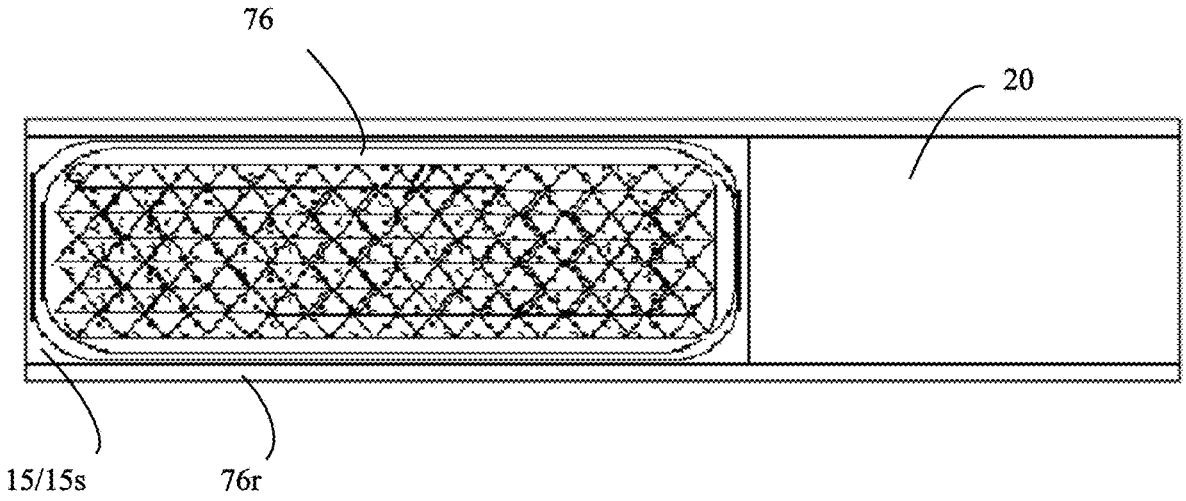
Figure 3C:
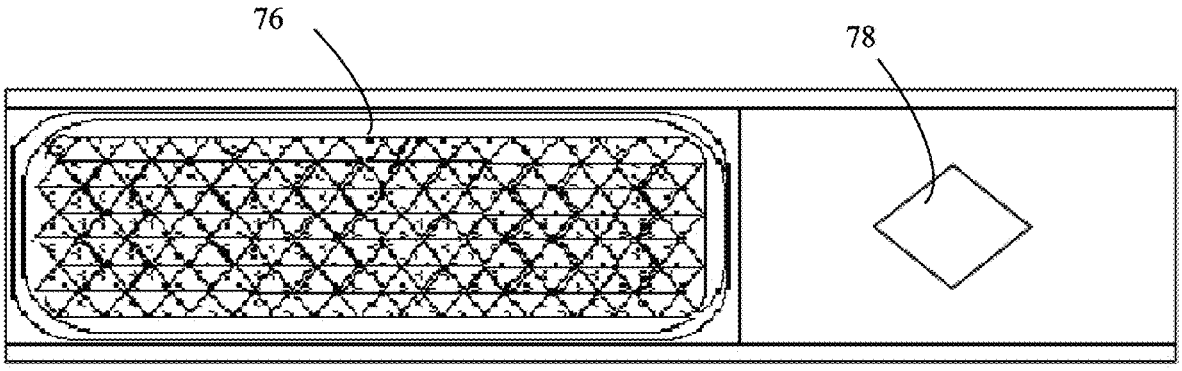
Figure 3D:
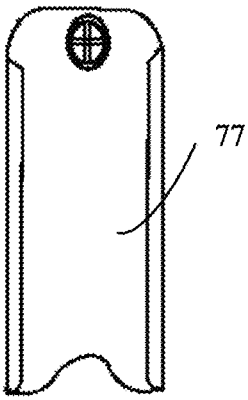
FIGS. 3D-3E represent one embodiment of a rasp and a rasp holder.
Figure 3E:
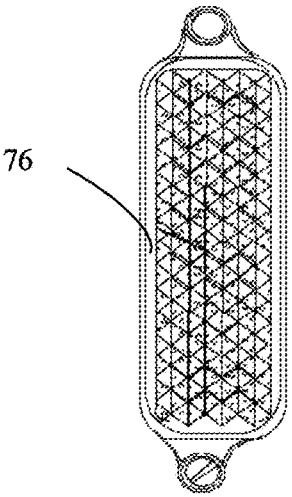
Figure 3F:
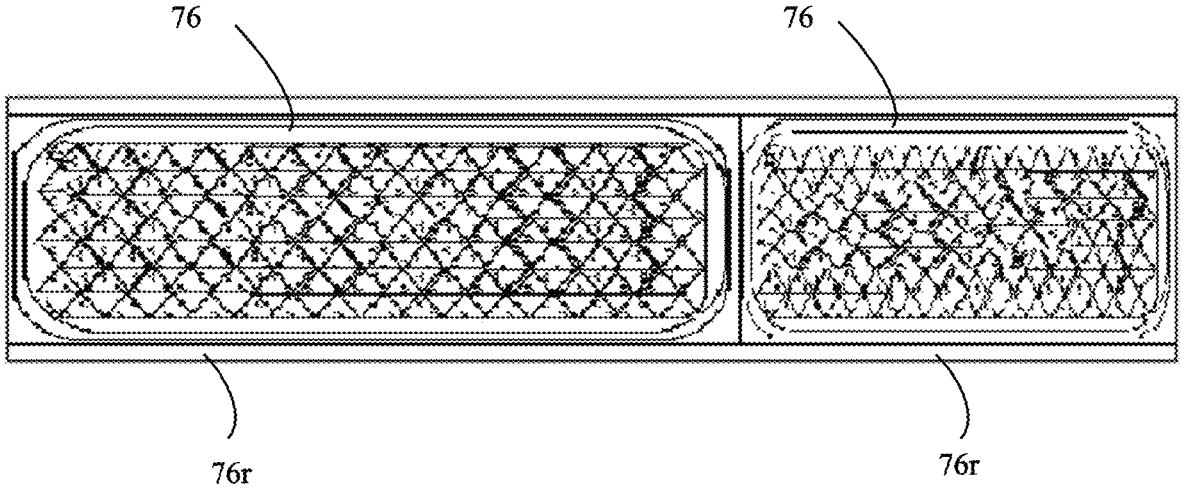

Referring to FIGS. 3C and 7A of the present invention, the multipurpose construction device (10) further includes a diamond shaped nail remover (78) disposed on the bottom surface (50) of the second segment (20) of the base or on a top surface area (40*s*) of the kicker area (40*s*). The diamond shape nail remover (78) will be comprised of a cavity like hole/opening configured to allow the tips/heads of nails, tacks, screws, or the like to be extracted. It is well known to a person skilled in the construction field how diamond shaped nail removers (78) are used.

It should be understood that the foregoing relates to various embodiments of the present invention which can be carried out independently and/or in combination and that modifications may be made without departing from the spirit and scope of the invention. It should be further understood that the present invention is not limited to the designs mentioned in this application and the equivalent designs in this description, but it is also intended to cover other equivalents now known to those skilled in the art, or those equivalents which may become known to those skilled in the art in the future.

INDUSTRIAL APPLICABILITY

The present invention relates to a multipurpose drywall and installation framing tool, which may be of value or importance to various industries, such as the retail, supplies, tools, and home improvement industries.

What is claimed is:

1. A multipurpose construction device comprising:

a one-piece frame comprised of a substantially solid rigid body, wherein the frame is further comprised of:

a base having first and second segments defined by a longitudinal axis that is parallel to a ground surface, the first and second segments of the base having a top surface and a bottom surface opposite to each other, the first and second segments of the base having a predefined length and a predefined width, wherein the base further includes a first axis of rotation located substantially at a point where the first and second segments of the base are joined for allowing the multipurpose construction device to rotate upward and downward at the first axis of rotation;

the first segment of the base is configured to project upward at a predefined first angle relative to longitudinal axis;

the second segment of the base is configured to project upward at a predefined second angle relative to the longitudinal axis, wherein the predefined angle of the second segment of the base is larger than the predefined angle of the first segment of the base;

a plurality of vertical support members affixed perpendicular to the top surface of the base, the vertical support members having a predefined height and a predefined width, wherein the predefined width of the vertical support members being substantially the same as the predefined width of the base, and wherein the width of the vertical support members are aligned with the width of the base;

an uppermost member having first and second segments, each of the segments of the uppermost member having a top surface area and a bottom surface area opposite to each other, wherein the bottom surface area of the uppermost member is affixed to top surfaces of the vertical support members forming a plurality of holding units disposed below the uppermost member, wherein the second segment of the uppermost member is configured to project downward at a third predefined angle relative to the longitudinal axis to form a palm support area;

a work surface area disposed on the top surface area of the first segment of the uppermost member;

a kicker area comprised of a vertical segment having a predefined height and a horizontal segment, wherein a bottom portion of the vertical segment is affixed to a top end point of the second segment of the base, the horizontal segment is affixed to a top portion of the vertical segment and configured to extend forwardly at a preselected length, wherein the horizontal segment is disposed substantially parallel to the ground and the vertical segment is disposed perpendicular to the horizontal segment forming a multifunctional hook-like mechanism, whereby the hook-like mechanism allows the multipurpose construction device to be secured to a pouch, pocket, or belt;

an open holding unit disposed between the kicker area and the palm support area and further disposed above the top surface of the second segment of the base; and a horizontal lip projecting forwardly on a front portion of the first segment of the base at a preselected length, the horizontal lip further having a top surface area and a tapered tip configured to be inserted beneath a construction panel, whereby the construction panel is lifted upward by applying pressure to the kicker via a user's foot, thereby enabling the multipurpose device to pivot upward at the first axis of rotation.

2. The multipurpose construction device of claim 1, wherein a note pad and a plurality of magnets are coupled to the work surface area.

3. The multipurpose construction device of claim 1, wherein each of the of the holding units are configured to fixedly store at least one construction tool.

4. The multipurpose construction device of claim 1, wherein the open holding unit is configured to fixedly store at least one construction tool.

5. The multipurpose construction device of claim 4, wherein the at least one construction tool is a third level configured to indicate straightness.

6. The multipurpose construction tool of claim 5, wherein the plurality of holding units are comprised of:

a first holding unit, a second holding unit disposed aft of the first holding unit, and a third holding unit disposed aft of the second holding unit, wherein the first holding unit is configured to fixedly store a chalk reel configured to mark a long, straight line on a flat surface, the second holding unit is configured to fixedly store a first level to indicate straightness, and the third holding unit is configured to fixedly store a second level to indicate straightness.

7. The multipurpose construction device of claim 6, wherein the second holding unit, the third holding unit and the open holding unit are configured to form in combination a torpedo level.

8. The multipurpose construction device of claim 6, wherein the vertical support members of first holding unit are comprised of a first wall and a second wall disposed aft of the first wall, and wherein the first wall has a port opening configured to allow a chalk line of the chalk reel to extend therethrough for laying out straight lines.

9. The multipurpose construction device of claim 6, wherein the vertical support members of the second holding unit are comprised of the second wall and a third wall disposed aft of the second wall, and wherein vertical support members of the third holding unit are comprised of the third wall and a fourth wall disposed aft of the third wall.

10. The multipurpose construction device of claim 1 further comprised of left-side and right-side wall assemblies, each wall assembly having measured markings affixed lengthwise on left and right side measuring surfaces disposed on the first segment of the uppermost member.

11. The multipurpose construction device of claim 1 further including a rasp coupled to the bottom surface of the first segment of the base.

12. The multipurpose construction device of claim 11, wherein the second segment of the uppermost member forms the palm support area to allow the user to place his or her palm thereon when using the rasp to smooth edges of a construction panel after cutting, wherein the construction panel is a drywall sheet.

13. The multipurpose construction device of claim 1 further including a diamond shaped nail remover disposed on the bottom surface of the second segment of the base or on a top surface area of the kicker area or on a top surface of the palm support area.

14. The multipurpose construction device of claim 1, wherein the construction panel is a wallboard, a drywall sheet, door, or plywood.

15. The multipurpose construction device of claim 1, wherein the vertical segment of the primary kicker area includes a rear port having a plurality of loading ports, thereby enabling the user to insert a writing device or a screw driver shaft therein for storage.

16. A multipurpose construction device comprising:

a one-piece frame comprised of a substantially solid rigid body, wherein the frame is further comprised of:

a base having first and second segments defined by a longitudinal axis that is parallel to a ground surface, the first and second segments of the base having a top surface and a bottom surface opposite to each other, the first and second segments of the base having a predefined length and a predefined width, wherein the base further includes a first axis of rotation located substantially at a point where the first and second segments of the base are joined for allowing the device to rotate upward and downward at the first axis of rotation;

the first segment of the base is configured to project upward at a predefined first angle relative to longitudinal axis;

the second segment of the base is configured to project upward at a predefined second angle relative to the longitudinal axis, wherein the predefined angle of the second segment of the base is larger than the predefined angle of the first segment of the base;

a plurality of vertical support members affixed perpendicular to the top surface of the base, the vertical support members having a predefined height and a predefined width, wherein the predefined width of the vertical support members being substantially the same as the predefined width of the base, and wherein the width of the vertical support members are aligned with the width of the base;

an uppermost member having first and second segments, each of the segments of the uppermost member having a top surface area and a bottom surface area opposite to each other, wherein the bottom surface area of the uppermost member is affixed to top surfaces of the vertical support members forming a plurality of holding units disposed below the uppermost member;

a kicker area comprised of a vertical segment having a predefined height and a horizontal segment, wherein a bottom portion of the vertical segment is affixed to a top end point of the second segment of the base, the horizontal segment is affixed to a top portion of the vertical segment and configured to extend forwardly at a preselected length, wherein the horizontal segment is disposed substantially parallel to the ground and the vertical segment is disposed perpendicular to the horizontal segment forming a multifunctional hook-like mechanism, whereby the hook-like mechanism allows the multipurpose construction device to be secured to a pouch, pocket, or belt; and a horizontal lip projecting forwardly on a front portion of the first segment of the base at a preselected length, the horizontal lip further having a top surface area configured to be inserted beneath a construction panel, whereby the construction panel is lifted upward by applying pressure to the kicker via a user's foot, thereby enabling the multipurpose device to pivot upward at the first axis of rotation.

17. The multipurpose construction device of claim 16, wherein each of the holding units are configured to fixedly store at least one construction tool.

18. The multipurpose construction device of claim 16 further comprised of left-side and right-side wall assemblies, each wall assembly having measured markings affixed lengthwise on left and right side measuring surfaces disposed on the first segment of the uppermost member.

19. The multipurpose construction device of claim 16, wherein the construction panel is a wallboard, a drywall sheet, door, or plywood.

20. A multipurpose construction device comprising:

a one-piece frame comprised of a substantially solid rigid body, wherein the frame is further comprised of:

a base having first and second segments defined by a longitudinal axis that is parallel to a ground surface, the first and second segments of the base having a top surface and a bottom surface opposite to each other, the first and second segments of the base having a predefined length and a predefined width, wherein the base further includes a first axis of rotation located substantially at a point where the first and second segments of the base are joined for allowing the multipurpose construction device to rotate upward and downward at the first axis of rotation;

the first segment of the base is configured to project upward at a predefined first angle relative to longitudinal axis;

the second segment of the base is configured to project upward at a predefined second angle relative to the longitudinal axis, wherein the predefined angle of the second segment of the base is larger than the predefined angle of the first segment of the base;

a plurality of vertical support members affixed perpendicular to the top surface of the base, the vertical support members having a predefined height and a predefined width, wherein the predefined width of the vertical support members being substantially the same as the predefined width of the base, and wherein the width of the vertical support members are aligned with the width of the base;

an uppermost member having first and second segments, each of the segments of the uppermost member having a top surface area and a bottom surface area opposite to each other, wherein the bottom surface area of the uppermost member is affixed to top surfaces of the vertical support members forming a plurality of holding units disposed below the uppermost member;

a kicker area comprised of a vertical segment having a predefined height and a horizontal segment, wherein the vertical segment is affixed to the second segment of the base, the horizontal segment is affixed to the vertical segment and configured to extend forwardly at a preselected length, wherein the horizontal segment is disposed substantially parallel to the ground and the vertical segment is disposed perpendicular to the horizontal segment forming a multifunctional hook-like mechanism;

an open holding unit disposed between the kicker area and the palm support area and further disposed above the top surface of the second segment of the base; and a horizontal lip projecting forwardly on a front portion of the first segment of the base at a preselected length, wherein the horizontal lip being configured to be inserted beneath a construction panel, whereby the construction panel is lifted upward by applying pressure to the kicker via a user's foot.

* * * * *